US009649684B2

(12) United States Patent
Kweon et al.

(10) Patent No.: US 9,649,684 B2
(45) Date of Patent: May 16, 2017

(54) TWIN ROLL STRIP CASTING METHOD

(71) Applicant: POSCO, Pohang-si (KR)

(72) Inventors: Oh Seong Kweon, Pohang-si (KR); Cheol Min Park, Pohang-si (KR); Suk Kyun Hwang, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 14/803,353

(22) Filed: Jul. 20, 2015

(65) Prior Publication Data

US 2016/0023268 A1 Jan. 28, 2016

(30) Foreign Application Priority Data

Jul. 24, 2014 (KR) ..... 10-2014-0094184

(51) Int. Cl.
*B22D 11/06* (2006.01)

(52) U.S. Cl.
CPC ..... *B22D 11/066* (2013.01); *B22D 11/0622* (2013.01)

(58) Field of Classification Search
CPC ..... B22D 11/0622; B22D 11/066
See application file for complete search history.

(56) References Cited

U.S. PATENT DOCUMENTS

2011/0073271 A1 3/2011 Kim et al.

FOREIGN PATENT DOCUMENTS

| | | |
|---|---|---|
| CN | 101543878 | 9/2009 |
| CN | 101801562 | 8/2010 |
| EP | 0788854 | 8/1997 |
| KR | 100605705 | 8/2006 |
| KR | 100798029 | 1/2008 |
| KR | 1020090024874 | 3/2009 |
| KR | 1020090032443 | 4/2009 |
| KR | 1020100063916 | 6/2010 |
| KR | 1020130075015 | 7/2013 |

OTHER PUBLICATIONS

Korean Office Action—Korean Application No. 10-2014-0094184 issued on Sep. 5, 2015, citing KR 10-0798029, KR 10-2009-0032443 and KR 10-2010-0063916.

*Primary Examiner* — Kevin P Kerns
*Assistant Examiner* — Steven Ha
(74) *Attorney, Agent, or Firm* — Cantor Colburn LLP

(57) ABSTRACT

There is provided a twin roll strip casting method. The twin roll strip casting method includes: continuously producing a strip by forming a molten steel pool using rotating rolls and edge dams contacting ends of the rotating rolls, and supplying molten steel to the molten steel pool; and lifting the edge dams by taking an amount of wear of the edge dams, occurring during casting, into consideration.

4 Claims, 7 Drawing Sheets

TWIN ROLL STRIP CASTING METHOD

CROSS-REFERENCE TO RELATED APPLICATION

This application claims the benefit of Korean Patent Application No. 10-2014-0094184 filed on Jul. 24, 2014, with the Korean Intellectual Property Office, the disclosure of which is incorporated herein by reference.

BACKGROUND

The present disclosure relates to a twin roll strip casting method, and more particularly, to a twin roll strip casting method for producing strips having a high degree of edge quality by using edge dams disposed on ends of casting rolls.

In a twin roll strip casting method of the related art, as illustrated in FIG. 1, molten steel 7 is dispensed through an injection nozzle (not shown) to a space between a pair of internal water-cooled rolls 1*a* and 1*b* that are rapidly rotated in mutually opposing directions, and a strip 5 having a thickness of 10 mm or less is extruded.

In the case of the twin roll strip casting method of the related art, two edge dams are attached to both ends of the pair of rolls 1*a* and 1*b* so as to prevent leakage of the molten steel 7. The pair of edge dams 10 may be seen as pressing devices disposed on the ends of the pair of rolls 1*a* and 1*b* to prevent leakage of the molten steel 7 from the space between the pair of rolls 1*a* and 1*b* past the ends of the pair of rolls 1*a* and 1*b*. During a casting process, a constant amount of back pressure is applied to the pair of edge dams 10 to maintain contact between the pair of edge dams 10 and the ends of the pair of rolls 1*a* and 1*b*.

In this structure, molten steel 7 is supplied to a molten steel pool formed between the pair of rolls 1*a* and 1*b* and the pair of edge dams 10 while the pair of rolls 1*a* and 1*b* are rotated in mutually opposing directions, and the molten steel 7 is extruded through a nip between the pair of rolls 1*a* and 1*b*, thereby continuously producing a strip 5.

In general, portions of the edge dams 10 actually making contact with the pair of rolls 1*a* and 1*b* and thus wearing down may be formed of a material that easily wears down so that the portions of the edge dams 10 may gradually wear down as the pair of rolls 1*a* and 1*b* are rotated. That is, while the pair of rolls 1*a* and 1*b* are rotated, the pair of rolls 1*a* and 1*b* dig into particular portions of the edge dams 10, and thus, leakage of molten steel 7 is surely prevented. The particular portions of the edge dams 10 are commonly formed of a composite refractory material mixed with boron nitride (BN).

Referring to FIG. 2, edge dam reinforcing portions 12, configured to easily wear down, are portions of edge dams making contact with protruding portions of a pair of rotating rolls. Hereinafter, the protruding portions of the pair of rolls will be referred to as roll edges 2 for clarity of description.

The roll edges 2 and the edge dam reinforcing portions 12 are in close contact with each other, and as the pair of rolls are rotated in mutually opposing directions, the edge dam reinforcing portions 12, commonly formed of a refractory material, are subjected to continuous friction with the roll edges 2 of the pair of rolls and thus gradually wear down.

Therefore, regions of the edge dam reinforcing portions 12 that frequently contact and rub against the protruding roll edges 2 are gradually worn down and recessed from the other non-worn regions of the edge dam reinforcing portions 12. Therefore, the non-worn regions of the edge dam reinforcing portions 12 relatively protrude in the direction of the ends of the rolls, compared to the worn regions of the edge dam reinforcing portions 12.

In this case, molten steel contained in a molten steel pool is pushed by the relatively protruding non-worn regions of the edge dam reinforcing portions 12, and thus the width of a produced strip is unintentionally reduced.

Therefore, in a strip casting process of the related art, edge dams are lifted as casting proceeds, so as to prevent a decrease in the width of a strip when the edge dam reinforcing portions 12 wear down. In this case, the surface quality of products may be varied according to a method of lifting the edge dams, and thus the action of lifting the edge dams may have a direct effect on product quality.

RELATED ART DOCUMENT (Patent Document 1) KR0605705B1 (registered on Jul. 20, 2006)

SUMMARY

An aspect of the present disclosure may provide a method of producing strips having a high degree of edge quality by preventing edge breakout in the strips.

An aspect of the present disclosure may also provide a method of preventing edge breakout by controlling the height of edge dams during casting.

According to the present disclosure, strips having a high degree of quality may be produced, and since defects are previously prevented, manufacturing costs, material costs, and labor costs may be saved. In addition, the efficiency of a twin roll strip casting process may be improved.

The present disclosure provides a twin roll strip casting method as described below.

According to an aspect of the present disclosure, a twin roll strip casting method may include: continuously producing a strip by forming a molten steel pool using rotating rolls and edge dams contacting ends of the rotating rolls, and supplying molten steel to the molten steel pool; and lifting the edge dams by taking an amount of wear of the edge dams, occurring during casting, into consideration.

The edge dams may be lifted while varying an edge dam lift ratio defined as a ratio of an increased height of the edge dams to the amount of wear of the edge dams.

The edge dam lift ratio may include a first lift ratio used in a case in which the amount of wear of the edge dams is less than a switch value and a second lift ratio used in a case in which the amount of wear of the edge dams is equal to or greater than the switch ratio, and the first lift ratio may less than the second lift ratio.

The switch value may range from 10 mm to 25 mm.

The first lift ratio may range from 1.1 to 1.5.

The edge dam lift ratio may be varied such that slopes formed on surfaces of the edge dams, worn-down by contact with the rolls may have a continuously varying shape.

The edge dam lift ratio may be varied such that slopes formed on surfaces of the edge dams, worn-down by contact with the rolls may have a linear shape.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
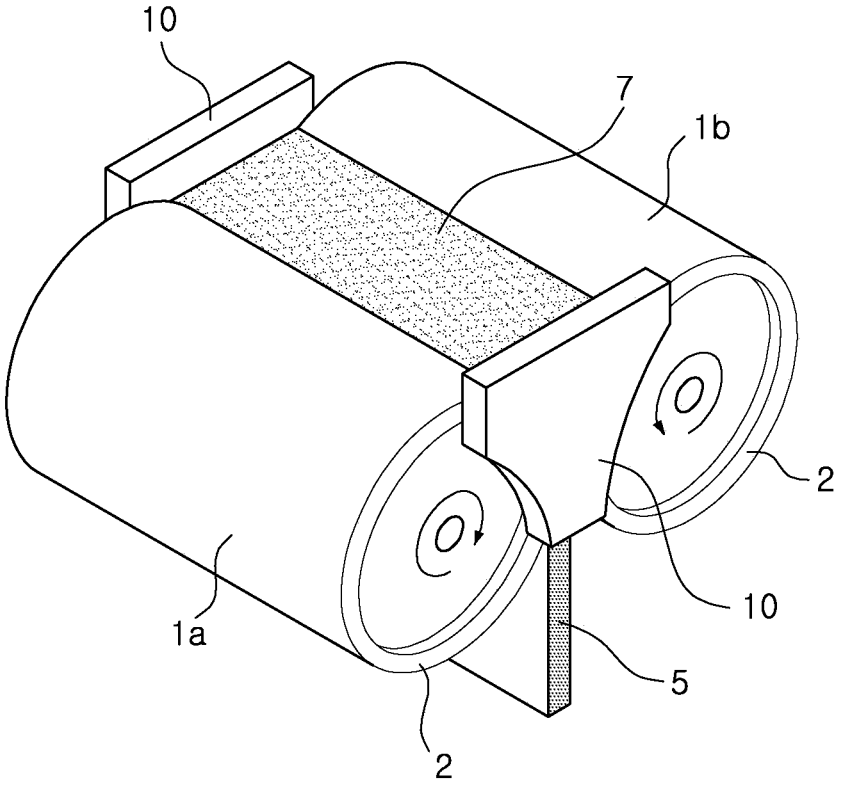
PRIOR ART FIG. 1
FIG. 1 is a schematic perspective view illustrating a twin roll strip casting process of the related art.

In the drawings attached to provide clear understanding of exemplary embodiments of the present disclosure, like reference numerals denote like elements, and elements having the same function and related to each other are denoted with the same reference numeral or are denoted with underlined reference numerals.

In addition, well-known elements and techniques will not be described in detail for clarity of descriptions of the exemplary embodiments of the present disclosure. Hereinafter, the exemplary embodiments of the present disclosure will be described in detail with reference to the accompanying drawings.

However, the scope of the present invention is not limited to the exemplary embodiments. That is, those of skill in the related art may propose other embodiments by adding, changing, or deleting elements without departing from the scope of the present invention.

Figure 2:
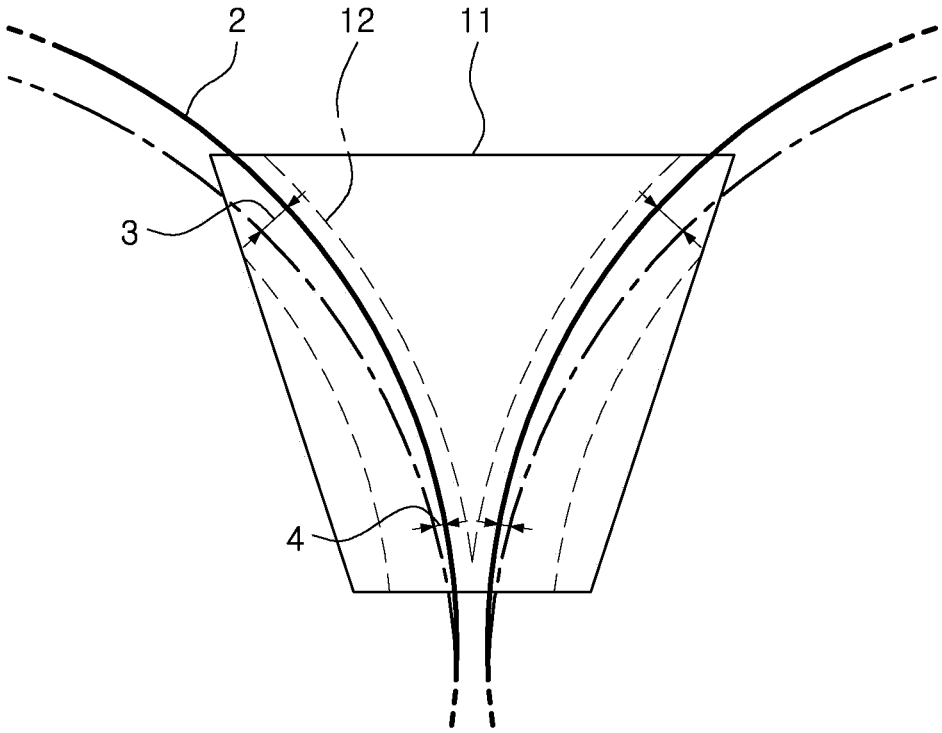
PRIOR ART FIG. 2
FIG. 2 is a schematic cross-sectional view illustrating how edge dams are lifted in a twin roll strip casting process of the related art.

As illustrated in FIG. 2, in a twin roll strip casting process, edge dam reinforcing portions 12 and roll edges 2 frequently rub against each other and thus inevitably wear down. Edge dams 10 (refer to FIG. 1) are brought into close contact with both ends of casting rolls 1*a* and 1*b* (refer to FIG. 1) that rotate at high speed, so as to seal a space between the ends of the casting rolls 1*a* and 1*b* and prevent leakage of molten steel through the ends of the casting rolls 1*a* and 1*b*.

Therefore, as a casting process proceeds, the roll edges 2 and the edge dam reinforcing portions 12 wear each other down. Thus, if the amount of wear on the edge dam reinforcing portions 12 is not properly compensated for, the width of a produced strip is reduced. That is, defective products may be produced.

The edge dams 10 are lifted somewhat after performing a casting process for a certain period of time so as to prevent the width of a strip from being decreased by interference between molten steel and the edge dam reinforcing portions 12. Then, regions of the edge dam reinforcing portions 12 which are worn down by frequent contact and friction with the roll edges 2 are lifted from the roll edges 2 by a certain amount, and non-worn regions of the edge dam reinforcing portions 12 are newly brought into contact with the roll edges 2, thereby maintaining the width of a strip at a constant level.

Herein, an edge dam lift ratio refers to a ratio of an increased height of the edge dams 10 to the amount of wear of the edge dams 10. For example, if the amount of wear of edge dams 10 is 1 mm and the increased height of the edge dams 10 is 1 mm, the edge dam lift ratio is 1. The edge dam lift ratio may be set according to the material, thickness, and wear amount of the edge dams 10.

As illustrated in FIG. 1, high-temperature molten steel 7 looses its heat while contacting the rolls 1*a* and 1*b* (a pair of water-cooled rolls), and thus a portion of the molten steel 7 may be solidified. Such a solidified portion is known as a skull or pluralities thereof are called skulls.

In addition, the edge dams 10 making contact with the pair of water-cooled rolls 1*a* and 1*b* also loose heat through the cooling effect of the pair of water-cooled rolls 1*a* and 1*b*. In this case, skulls may repeatedly grow on the surfaces of the edge dams 10 and be separated therefrom.

Figure 3:
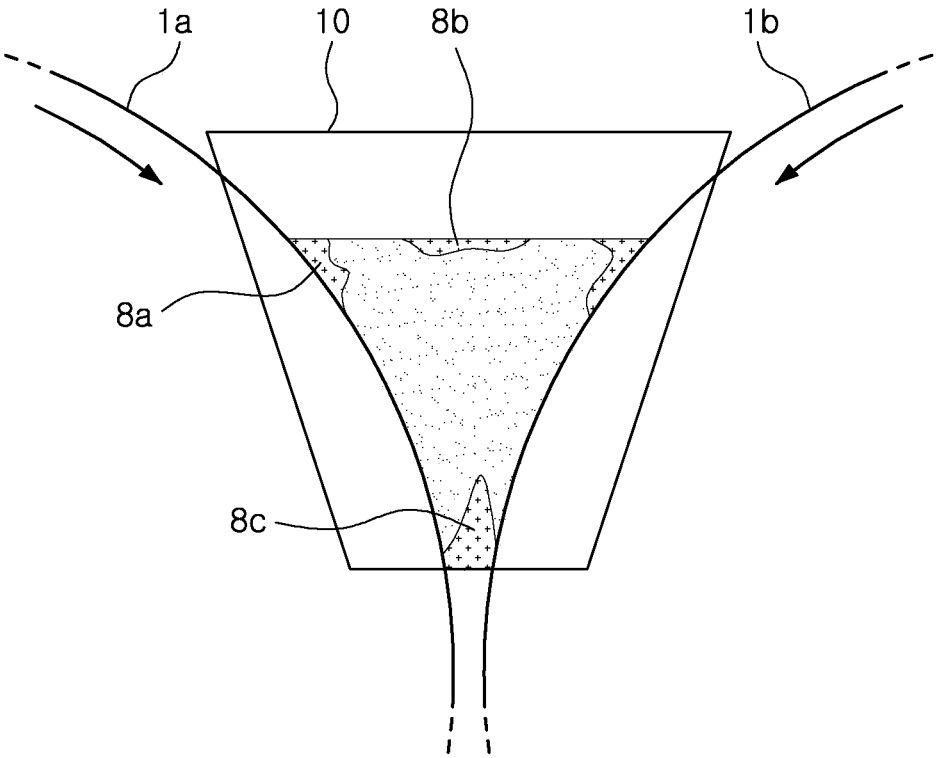
PRIOR ART FIG. 3
FIG. 3 is a schematic cross-sectional view illustrating how skulls are formed during a twin roll strip casting process of the related art.

FIG. 3 illustrates an exemplary generation state of such skulls. The skulls may be named an edge skull 8*a*, a mold level skull 8*b*, and a lower skull 8*c* according to the positions of the skulls relative to operational surfaces of the pair of rolls 1*a* and 1*b* and the edge dams 10.

Figure 4A:
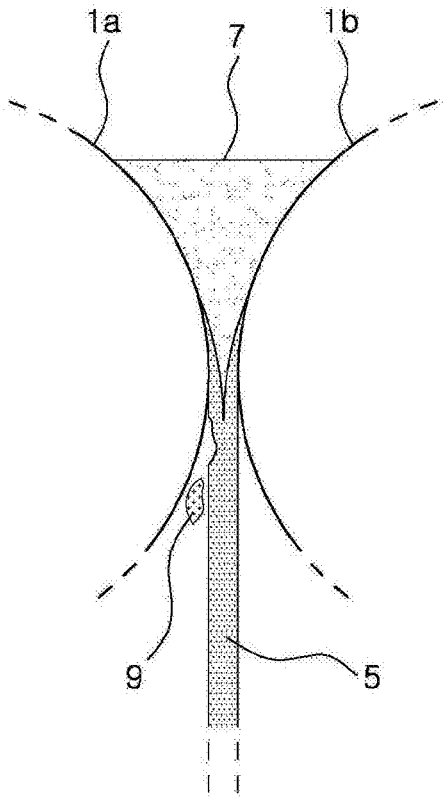
PRIOR ART FIG. 4A
FIGS. 4A and 4B illustrate how an edge portion breaks out due to the inclusion of a skull in a twin roll strip casting process of the related art.
Figure 4B:
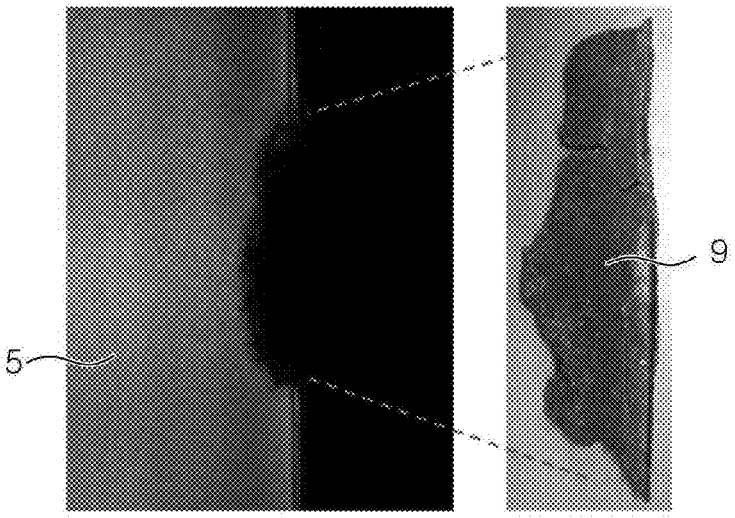
PRIOR ART FIG. 4B

Particularly, during casting, edge skulls 8*a* repeatedly grow on the surfaces of the edge dams 10 and separates from the surfaces of the edge dams 10 and may be included in an edge portion of a strip 5 (refer to FIG. 4A). In this case, the edge skulls 8*a* may create one-sided edge fins, and thus when the strip 5 passes through a nip between the pair of rolls 1*a* and 1*b*, an edge piece 9 may be broken off, as illustrated in FIGS. 4A and 4B. That is, the strip 5 may undergo edge breakout.

The inclusion of such skulls in an edge portion of the strip 5 and a consequent edge breakout phenomenon may be direct causes of edge defects of the strip 5 and may be crucial factors making it difficult to produce strips having high edge quality.

Moreover, if the edge dams 10 are lifted to compensate for wear of the edge dams 10, conditions facilitating the formation of skulls are created. Thus, when the edge dams 10 are lifted, many skulls may probably be formed and included in an edge portion of the strip 5.

Referring to FIG. 3, among the edge skull 8*a*, the mold level skull 8*b*, and the lower skull 8*c* that are formed when molten steel is partially solidified while being cooled by the pair of water-cooled rolls 1*a* and 1*b*, the inclusion of the edge skull 8*a* in an edge portion of the strip 5 is markedly affected by the lifting of the edge dams 10.

As a casting process proceeds, the pair of rolls 1*a* and 1*b* and the edge dam reinforcing portions 12 gradually wear each other down and increase in wear depth. In this case, if the edge dams 10 are lifted, worn-down slopes may be formed on the edge dam reinforcing portions 12.

That is, as described above with reference to FIG. 3, if the edge dams 10 are lifted, the traces of the pair of rolls 1*a* and 1*b* are lowered, relative to the edge dams 10. In this case, as illustrated in FIG. 2, an upper descent distance 3 and a lower descent distance 4 are different from each other.

In other words, if the edge dams 10 are lifted, the traces of the rolls 1*a* and 1*b* are lowered relative to the edge dams 10. At this time, the roll edges 2 are lowered by different descent distances at upper and lower portions of the rolls 1*a* and 1*b*.

That is, as illustrated in FIG. 2, when the edge dams 10 are lifted, the roll edges 2 are lowered relative to positions at which the roll edges 2 first made contact with the edge dam reinforcing portions 12. At this time, the upper descent distance 3 is greater than the lower descent distance 4.

Figure 5A:
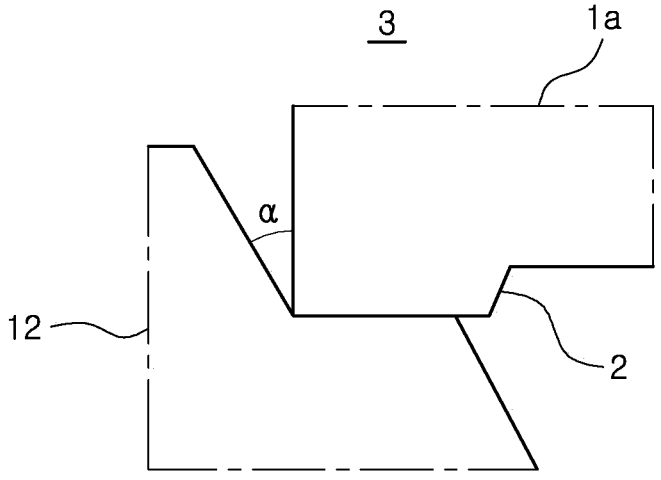
PRIOR ART FIG. 5A
FIGS. 5A and 5B are schematic cross-sectional views illustrating the state of an edge dam and a casting roll when edge dams are lifted during a twin roll strip casting process of the related art.

FIG. 5A is a schematic cross-sectional view illustrating regions of an edge dam reinforcing portion 12 and a roll edge 2 where the upper descent distance 3 is measured. In FIG. 5A, α refers to an angle between the roll edge 2 and a worn-down slope of the edge dam reinforcing portion 12.

Figure 5B:
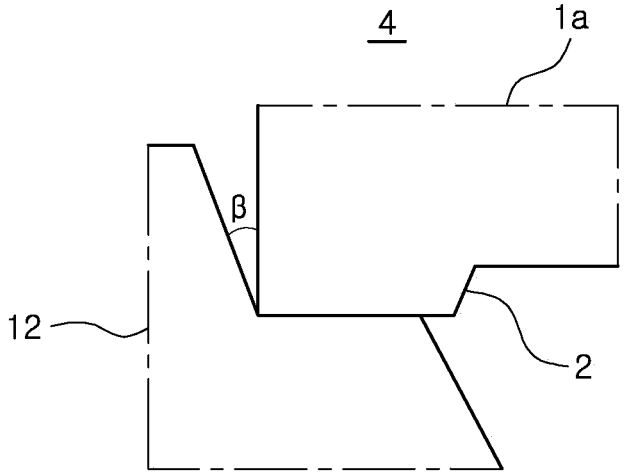
PRIOR ART FIG. 5B

FIG. 5B is a schematic cross-sectional view illustrating regions of the edge dam reinforcing portion 12 and the roll edge 2 where the lower descent distance 4 is measured. In FIG. 5B, β refers to an angle between the roll edge 2 and a worn-down slope of the edge dam reinforcing portion 12.

If the angles α and β are compared, angle α measured at the upper descent distance 3 is greater than the angle β measured at the lower descent distance 4 because the upper descent distance 3 is greater than the lower descent distance 4. In other words, because the traces of the rolls 1*a* and 1*b* vary from lower sides to upper sides thereof, worn-down slopes vary from the lower sides to the upper sides of the rolls 1*a* and 1*b*. That is, the angles α and β have different values on the lower and upper sides of the rolls 1*a* and 1*b*.

Therefore, as casting proceeds, the angle of the worn-down slopes of the edge dams 10 decreases from upper sides to lower sides of the edge dams 10. In addition, spaces between the roll edges 2 and the worn-down slopes of the edge dam reinforcing portions 12, that is, spaces formed by the angles α and β, are easily decreased in temperature due to the structures thereof, and thus conditions facilitating the formation of skulls are created in the spaces.

Particularly, the formation of skulls increases as the abrasion of the edge dams 10 proceeds and the depth of the worn-down slopes increases, that is, as the angles α and β decrease.

Therefore, so as to suppress the formation of skulls caused by a temperature decrease in spaces formed by worn-down slopes and to prevent the inclusion of skulls in a strip, an exemplary embodiment of the present disclosure provides a twin roll strip casting method. The twin roll strip casting method includes a first operation of forming a molten steel pool by a plurality of rotating rolls 1*a* and 1*b* and edge dams 10 contacting ends of the rolls 1*a* and 1*b*; a second operation of continuously producing a strip 5 by supplying molten steel to the molten steel pool; and a third operation of lifting the edge dams 10 with an edge dam lift ratio varying according to the progress of casting, the edge dam lift ratio being a ratio of an increased height of the edge dams 10 to the amount of wear of the edge dams 10.

In the third operation, the edge dame lift ratio is defined as a ratio of an increased height of the edge dams 10 to the amount of wear of the edge dams 10, and the edge dams 10 are lifted step by step with a predetermined edge dam lift ratio and then with a varying edge dam lift ratio after the amount of wear of the edge dams 10 becomes greater than a switch value.

For example, if the edge dams 10 are lifted by 1 mm when the amount of wear of the edge dams 10 is 1 mm, the edge dam lift ratio is 1. The edge dam lift ratio may be varied according to casting conditions such as the thickness and material of the edge dams 10 and the kind of molten steel to be cast. That is, the edge dam lift ratio is not set according to a fixed reference.

However, the core idea of the present disclosure is to maintain the edge dam lift ratio at a constant level before the amount of wear of the edge dams 10 reaches the switch value and to vary the edge dam lift ratio after the amount wear of the edge dams 10 reaches the switch value.

Figure 6:
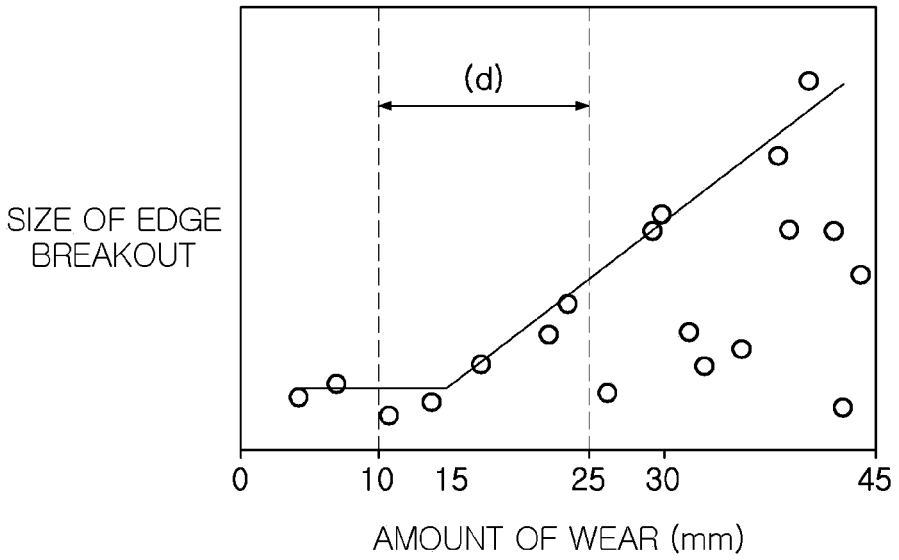
PRIOR ART FIG. 6
FIG. 6 is a graph illustrating the size of edge breakout with respect to the amount of wear of edge dams in a twin roll strip casting process of the related art.
Figure 7:
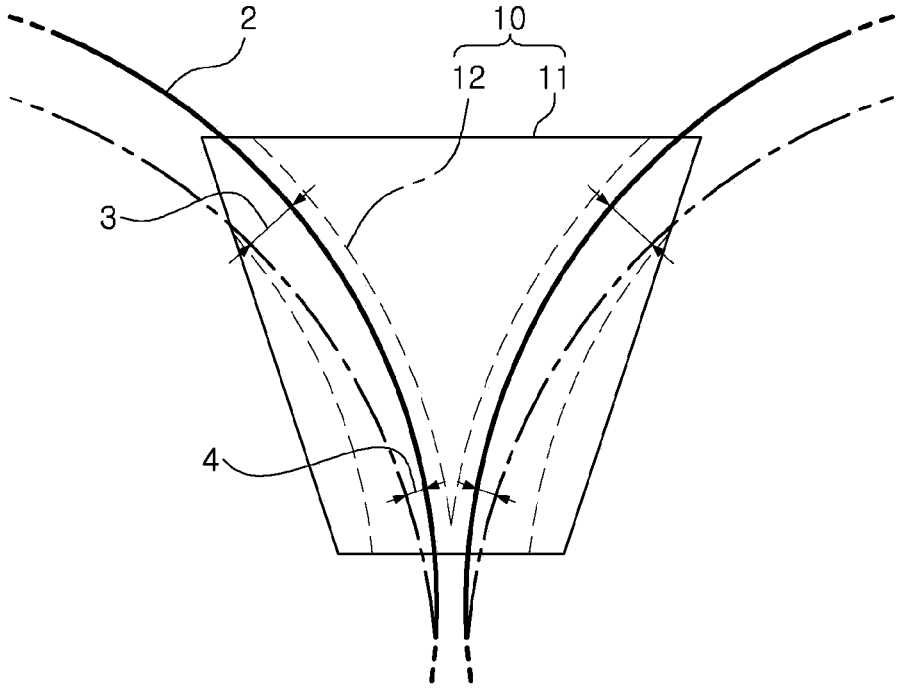
FIG. 7 is a schematic view illustrating how edge dams are lifted according to an exemplary embodiment of the present disclosure.

Preferably, the switch value may range from 10 mm to 25 mm. Referring to FIG. 6, when the amount of wear of the edge dams 10 is less than about 15 mm, a curve indicating the size of edge breakout has a relatively small slope. However, when the amount of wear of the edge dams 10 is about 15 mm or greater, the curve has a large slope.

Although the size of edge breakouts starts to steeply increase after the amount of wear of the edge dams 10 reaches 15 mm, edge defects formed when the amount of wear of the edge dams 10 ranges from 10 mm to 25 mm (region (d) in FIG. 6) may be removed in a later trimming process. Thus, the switch value may be set to be within the range of 10 mm to 25 mm.

Therefore, according to the exemplary embodiment of the present disclosure, when the amount of wear of the edge dams 10 is outside the range of 10 mm to 25 mm, the edge dam lift ratio may be varied. Particularly, when the amount of wear of the edge dams 10 is 25 mm or greater, the edge dam lift ratio may be increased. If the edge dam lift ratio is increased, the edge dams 10 are lifted further, as compared to the amount of wear of the edge dams 10.

That is, if the edge dams 10 are lifted much more compared to the amount of wear of the edge dams 10 as described above, an upper descent distance 3 and a lower descent distance 4 are increased much more compared to the case in which the edge dam lift ratio is 1. That is, the lower descent distance 4, directly related to edge breakouts, is increased.

The reason for this is to increase an angle β measured at a lower side having conditions facilitating the formation of skulls. This will now be described in more detail with reference to FIGS. 8A to 8C in which cross-sectional views of an edge dam reinforcing portion 12 and the roll 1*a* are illustrated.

Figure 8A:
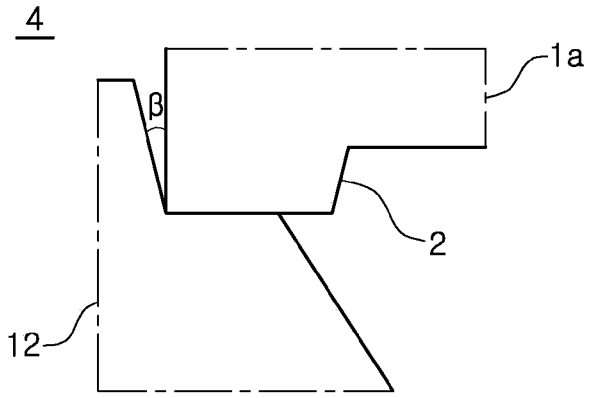
FIGS. 8A to 8C are schematic cross-sectional views illustrating the state of an edge dam and a casting roll when edge dams are lifted during a twin roll strip casting process according to an exemplary embodiment of the present disclosure.
Figure 8B:
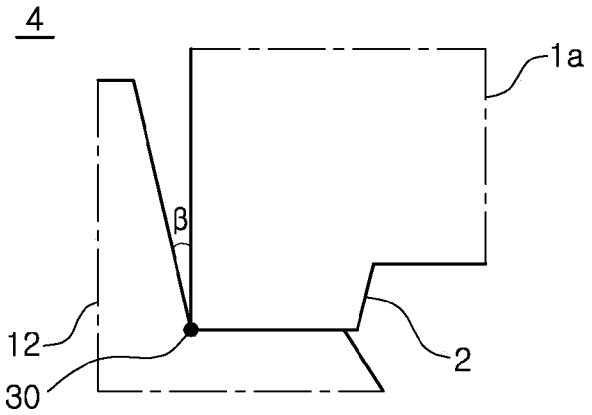
Figure 8C:
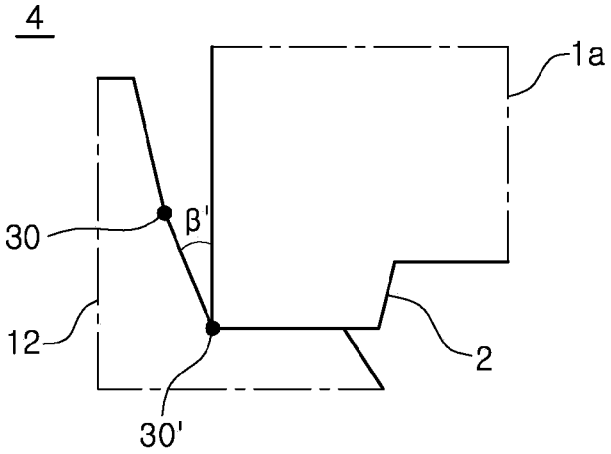

FIGS. 8A to 8C are cross-sectional views illustrating regions of the edge dam reinforcing portion 12 and the roll 1*a* where the lower descent distance 4 is measured. Referring to FIG. 8A, a worn-down slope having an angle β is formed in the middle of casting as the roll edge 2 of the roll 1*a* and the edge dam reinforcing portion 12 wear each other down.

When the angle β is small, a space between the edge dam reinforcing portion 12 and the roll edge 2 is narrow. If the angle β is maintained to be relatively narrow, while the depth of wear increases as casting proceeds, a very small amount of molten steel 7 may be introduced into the space formed by the angle β. Therefore, the molten steel 7 may easily be cooled by the pair of water-cooled rolls 1*a* and 1*b*, and thus skulls may easily be formed by the solidification of the molten steel 7.

Therefore, according to an exemplary embodiment of the present disclosure, a switch point 30 is changed to a new point 30' so as to prevent conditions facilitating the formation of skulls.

FIG. 8B is a cross-sectional view illustrating the edge dam reinforcing portion 12 and the roll edge 2 in the middle of casting when the edge dams 10 are lifted with a constant edge dam lift ratio regardless of the amount of wear of the edge dams 10 according to technology of the related art.

On the contrary, FIG. 8C is a cross-sectional view illustrating the edge dam reinforcing portion 12 and the roll edge 2 in the middle of casting when the edge dams 10 are lifted with an increased edge dam lift ratio after the amount of wear of the edge dams 10 reaches a value of 14 mm to 16 mm.

When the amount of wear of the edge dams 10 is within or greater than the range of 14 mm to 16 mm, if the edge dams 10 are lifted with a constant edge dam lift ratio, the switch point 30 at which wear starts is located as illustrated in FIG. 8B.

However, when the amount of wear of the edge dams 10 is within or greater than the range of 14 mm to 16 mm, if the edge dams 10 are lifted much more with an increased edge dam lift ratio, a switch point 30' at which wear starts is located below the switch point 30 at which wear starts when the edge dam lift ratio is maintained at a constant level.

If the edge dam lift ratio is increased as described above, the angle β between the edge dam reinforcing portion 12 and the roll edge 2 of the roll 1*a* is increased to a new value β' at the lower descent distance 4, and thus a space between the edge dam reinforcing portion 12 and the roll edge 2 of the roll 1*a* may be widened.

Therefore, a relatively large amount of molten steel may be introduced into the widened space, and the introduced molten steel may be less cooled, thereby suppressing the formation of skulls.

In other words, if the amount of wear of the edge dams 10 is within or greater than the range of 14 mm to 16 mm, the edge dam lift ratio may be increased to increase the angle β to a new value β' and to change the worn-down slope of the edge dam reinforcing portion 12, thereby preventing conditions facilitating the formation of skulls. That is, the angle of the worn-down slope is increased to introduce more molten steel and to thus reduce cooling of the molten steel on the worn-down slope.

However, generally, the edge dam lift ratio is not increased to a value greater than 1.5 so as to maintain lower end sealing positions of the edge dams 10 at a level lower than a nip point at which solidified shells meet each other. If the edge dams 10 are lifted to a limit position or higher, molten steel may leak, and casting may not be performed.

In other words, the upper limit of the edge dam lift ratio may be determined by the maximum height of the edge dams 10. The maximum height of the edge dams 10 may be a height equal to or higher than the nip point, and immediately above the maximum height, molten steel may start to leak.

Consequently, at the moment when the amount of wear of the edge dams 10 reaches 25 mm from the range of 10 mm to 25 mm, the edge dam lift ratio may be first increased. However, the edge dam lift ratio is controlled to be within the range of 1.1 to 1.5 for stably casting.

In addition, the edge dam lift ratio (second edge dam lift ratio) used for the case when the amount of wear of the edge dams 10 is 25 mm or greater may result in the formation of linear or nonlinear worn-down slopes on the edge dam reinforcing portions 12 of the edge dams 10. In this case, however, the angle between the roll edges 2 and the worn-down slopes by the second edge dam lift ratio is greater than the angle between the roll edges 2 and worn-down slopes formed by a first edge dam lift ratio used for the case when the amount of wear of the edge dams 10 is less than 25 mm.

If the worn-down slopes formed by the second edge dam lift ratio are nonlinear, the worn-down slopes may include at least one slope change point. According to an exemplary embodiment of the present disclosure, the slope change point may be the switch point 30 illustrated in FIG. 8C.

In addition, the edge dam lift ratio may be varied such that worn-down slopes of the edge dams 10 formed by contact with the rolls 1*a* and 1*b* may have a continuously varying shape. The expression "worn-down slopes have a continuously varying shape" means that the worn-down slopes are entirely continuous and are thus differentiable.

In addition, the edge dam lift ratio may be varied such that worn-down slopes of the edge dams 10 formed by contact with the rolls 1*a* and 1*b* may have a linear shape. In this case, the expression "worn-down slopes have a linear shape" means that the worn-down slopes are not non-linear and are linear so as to be entirely continuous and thus differentiable (for example, linear differentiation).

As set forth above, according to the twin roll strip casting method described according to the exemplary embodiments of the present disclosure, strips having a high degree of edge quality may simply be produced by using the edge dams 10 without using additional equipment.

In addition, since separation of edge portions from strips is previously prevented, costs necessary for removing edge defects such as material costs, process costs, or labor costs may be saved, and thus manufacturing costs may be reduced.

Furthermore, since edge defects are previously prevented, processes for removing edge defects may be omitted or simplified, and thus the efficiency of entire manufacturing processes may be improved.

While exemplary embodiments have been shown and described above, it will be apparent to those skilled in the art that modifications and variations could be made without departing from the scope of the present invention as defined by the appended claims.

What is claimed is:

1. A twin roll strip casting method comprising:

continuously producing a strip by forming a molten steel pool using rotating rolls and edge dams contacting ends of the rotating rolls, and supplying molten steel to the molten steel pool; and lifting the edge dams by taking an amount of wear of the edge dams, occurring during casting, into consideration, wherein the edge dams are lifted by an edge dam lift ratio defined as a ratio of an increased height of the edge dams to the amount of wear of the edge dams, the edge dam lift ratio including a first lift ratio and a second lift ratio greater than the first lift ratio;

wherein the edge dams are lifted by the first lift ratio forming a first angle between the ends of the rolls and worn-down slopes formed on surfaces of the edge dams in a case where the amount of wear of the edge dams is less than a switch value defined by the amount of wear of the edge dams, and by the second lift ratio forming a second angle between the ends of the rolls and the worn-down slopes in a case where the amount of wear of the edge dams is equal to or greater than the switch value; and wherein the switch value ranges from 10 mm to 25 mm, and the second angle is greater than the first angle.

2. The twin roll strip casting method of claim 1, wherein the second lift ratio is 1.1 to 1.5 times the first lift ratio.

3. The twin roll strip casting method of claim 1, wherein the edge dam lift ratio is varied such that the worn-down slopes have a continuously varying shape.

4. The twin roll strip casting method of claim 1, wherein the edge dam lift ratio is varied such that the worn-down slopes have a linear shape.

* * * * *